US005461283A

United States Patent [19]

Thornber et al.

[11] Patent Number: 5,461,283

[45] Date of Patent: Oct. 24, 1995

[54] MAGNETRON OUTPUT TRANSITION APPARATUS HAVING A CIRCULAR TO RECTANGULAR WAVEGUIDE ADAPTER

[75] Inventors: Geoffrey Thornber, Aptos, Calif.; Charles F. Malcolm, III, Williamsport, Pa.

[73] Assignee: Litton Systems, Inc., Beverly Hills, Calif.

[21] Appl. No.: 99,064

[22] Filed: Jul. 29, 1993

[51] Int. Cl.[6] ..... H01J 23/40; H01J 23/46

[52] U.S. Cl. ..... 315/39.53; 333/21 R

[58] Field of Search ..... 315/39.53, 39.51; 333/21 R

[56] References Cited

U.S. PATENT DOCUMENTS

| | | | |
|---|---|---|---|
| 2,886,742 | 5/1959 | Hull | 315/39.53 X |
| 2,972,084 | 2/1961 | Esterson et al. | 315/39.53 |
| 3,113,239 | 12/1963 | Hass | 315/39.53 X |
| 3,173,054 | 3/1965 | Baker | 315/39.53 |
| 3,305,693 | 2/1967 | Hull | 315/39.69 |
| 5,210,465 | 5/1993 | Squibb | 315/39.53 |

FOREIGN PATENT DOCUMENTS

| | | |
|---|---|---|
| 988142 | 4/1965 | United Kingdom . |
| 1134734 | 11/1968 | United Kingdom . |
| 1365644 | 9/1974 | United Kingdom . |

*Primary Examiner*—Benny T. Lee
*Attorney, Agent, or Firm*—Graham & James

[57] ABSTRACT

A magnetron transition apparatus is provided which permits transmission of a microwave RF signal between a magnetron and an output waveguide. The transition apparatus is connected to the magnetron and receives the RF signal from the magnetron, while maintaining a substantially vacuum environment therein. The transition apparatus further comprises an RF interface between the substantially vacuum environment and a non-vacuum environment within the output waveguide. The microwave RF signal from the magnetron is transmitted through the transition apparatus into the output waveguide. The transition structure comprises an adapter having a first portion of generally circular cross-section and a second portion of generally rectangular cross-section. A conductive loop electrically connected to an anode structure of the magnetron is disposed within the first portion and inductively couples the RF signal from the magnetron into the transition apparatus. The RF interface further comprises an RF transparent window connected between the second portion of the adapter and the output waveguide. The second portion of the adapter has a cross-section consistent with that of the output waveguide.

15 Claims, 2 Drawing Sheets

FIG. 3
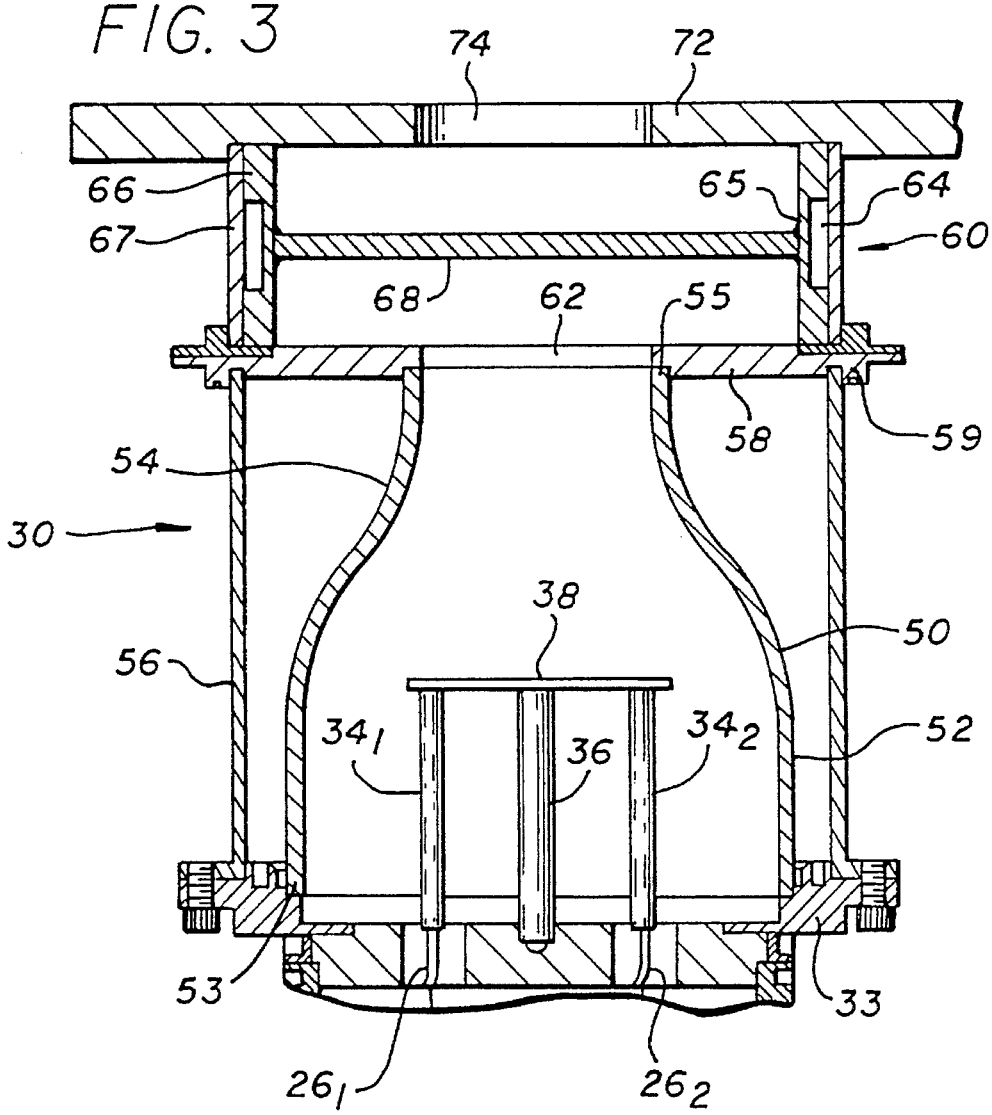
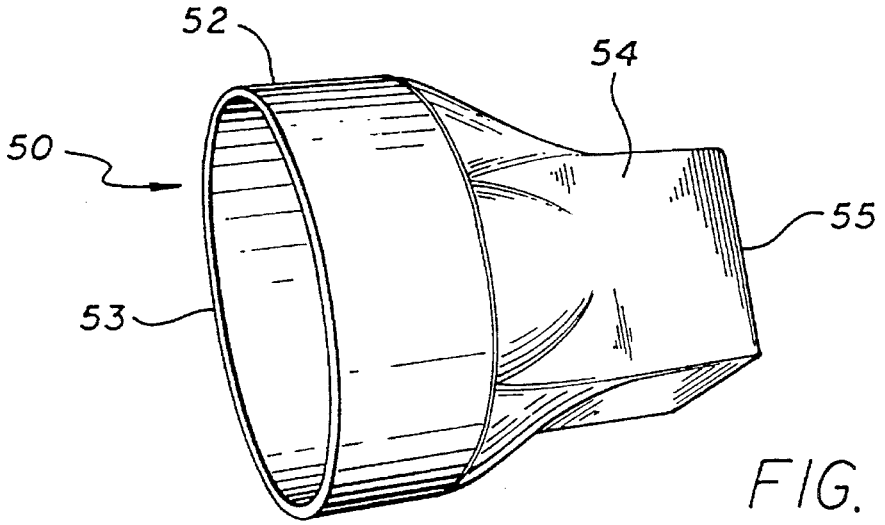
FIG. 4

MAGNETRON OUTPUT TRANSITION APPARATUS HAVING A CIRCULAR TO RECTANGULAR WAVEGUIDE ADAPTER

BACKGROUND OF THE INVENTION

1. Field of the Invention

The present invention relates to magnetrons for producing high power electromagnetic radio frequency (RF) energy, and more particularly, to an output transition apparatus for a magnetron to couple the high power RF energy into an output waveguide.

2. Description of Related Art

Magnetrons have been used for many years in electronic systems that require high RF power in the microwave range, such as radar systems. A magnetron typically includes a cylindrical shaped cathode coaxially disposed within an anode structure, forming an interaction region between the cathode surface and the anode. The anode structure may include a network of vanes which provides a resonant cavity tuned to a frequency of oscillation for the magnetron. The RF microwave power produced by the magnetron is coupled into an output waveguide, which can direct the RF energy to a load, such as an antenna or other device.

Upon application of an electric potential between the cathode and the anode, which forms an electric field causing the cathode surface to emit a space-charge cloud of electrons. A magnetic field is provided along the cathode axis, perpendicular to the electric field, which causes the emitted electrons to spiral into cycloidal paths in orbit around the cathode. When RF fields are present on the anode structure, the rotating space-charge cloud is concentrated into a spoke-like pattern. This is due to the acceleration and retardation of electrons in regions away from the spokes. The electron bunching induces high RF voltages on the anode structure, and the RF levels build up until the magnetron is drawing full peak current for any given operating voltage. Electron current flows through the spokes from the cathode to the anode, producing a high power RF output signal at the desired frequency of oscillation.

Since desirable operation of the magnetron is achieved by maintaining a vacuum environment within the magnetron, and there is a non-vacuum environment within the output waveguide, a vacuum barrier must be provided between the magnetron and output waveguide. One type of magnetron utilizes a glass dome as a vacuum barrier between the vacuum and non-vacuum environments. The electromagnetic signal is coupled into the space formed below the dome, and the signal radiates through the dome. The glass material of the dome provides an RF transparent barrier which allows the signal to be effectively transported into the output waveguide, while maintaining a vacuum seal within the magnetron.

One drawback with this approach is that the glass material of the dome cannot withstand high temperatures. It is common to perform a high temperature processing of the magnetron components, including the cathode and anode structure, during fabrication processing of the magnetron. This high temperature processing tests the temperature limits of the device, and forces certain chemical elements of the components into a vaporous state at which they can be removed from the device. Without performing this high temperature processing, these elements could be emitted during operation of the magnetron. Emission of the chemical elements could alter the electrical and resonant characteristics of the magnetron in an undesirable manner. Thus, it is preferred to perform the high temperature processing at as high a temperature as the magnetron can withstand.

However, the glass dome which provides the vacuum barrier between the magnetron and the output waveguide is generally unable to withstand such high temperatures. The glass material would tend to soften, resulting in reduction of structural integrity of the dome, and possible loss of the vacuum environment. To remedy this situation, the high temperature processing must be conducted at a temperature level somewhat below the critical temperature for the glass dome. This reduces the effectiveness of the high temperature processing, and limits the operational range of the magnetron.

As an alternative to reducing the effectiveness of the high temperature processing, other materials have been suggested for formation of the dome, such as ceramic. Ceramic materials are known to be capable of withstanding very high temperatures and could be a suitable material to replace the glass dome. However, ceramic is relatively difficult and expensive to form into a dome shape conducive to effective transmission of RF energy using conventional machining techniques.

Accordingly, a need exists to provide a magnetron transition apparatus which provides for efficient coupling of electromagnetic RF energy between the vacuum environment of the magnetron and the non-vacuum environment of the output waveguide. The magnetron transition apparatus should be capable of withstanding high temperature processing during manufacture of the magnetron components, and should be relatively inexpensive to fabricate.

SUMMARY OF THE INVENTION

In addressing these needs and deficiencies of the prior art, a magnetron output transition apparatus is provided. The magnetron output transition apparatus of the present invention permits the transmission of a microwave RF signal between a magnetron and an output waveguide. The transition apparatus is connected to the magnetron in place of the glass dome and receives the RF microwave signal from the magnetron, while maintaining a substantially vacuum environment therein. The magnetron transition further comprises a vacuum interface between the substantially vacuum environment and the non-vacuum environment within the output waveguide. The microwave RF signal from the magnetron is transmitted through the transition apparatus into the output waveguide.

More particularly, the transition apparatus comprises an adapter having a first portion of generally circular cross-section and a second portion of generally rectangular cross-section. The circular cross-section portion is adapted to replace the glass dome normally utilized with the magnetron. A conductive loop electrically connected to an anode structure of the magnetron is disposed within the first portion and inductively couples the RF signal from the magnetron into the adapter. The vacuum interface further comprises an RF transparent window connected between the second portion of the adapter and the output waveguide. The output waveguide has a cross-section consistent with the second portion of the adapter.

A more complete understanding of the magnetron transition apparatus will be afforded to those skilled in the art, as well as a realization of additional advantages and objects thereof, by a consideration of the following detailed description of the preferred embodiment. Reference will be made to the appended sheets of drawings which will be first described briefly.

BRIEF DESCRIPTION OF THE DRAWINGS

FIG. 3 is a sectional side view of a magnetron output transition apparatus constructed in accordance with the principles of the present invention; and FIG. 4 is a perspective view of an adapter used in the magnetron transition apparatus of FIG. 3.

DETAILED DESCRIPTION OF THE PREFERRED EMBODIMENT

Figure 1:
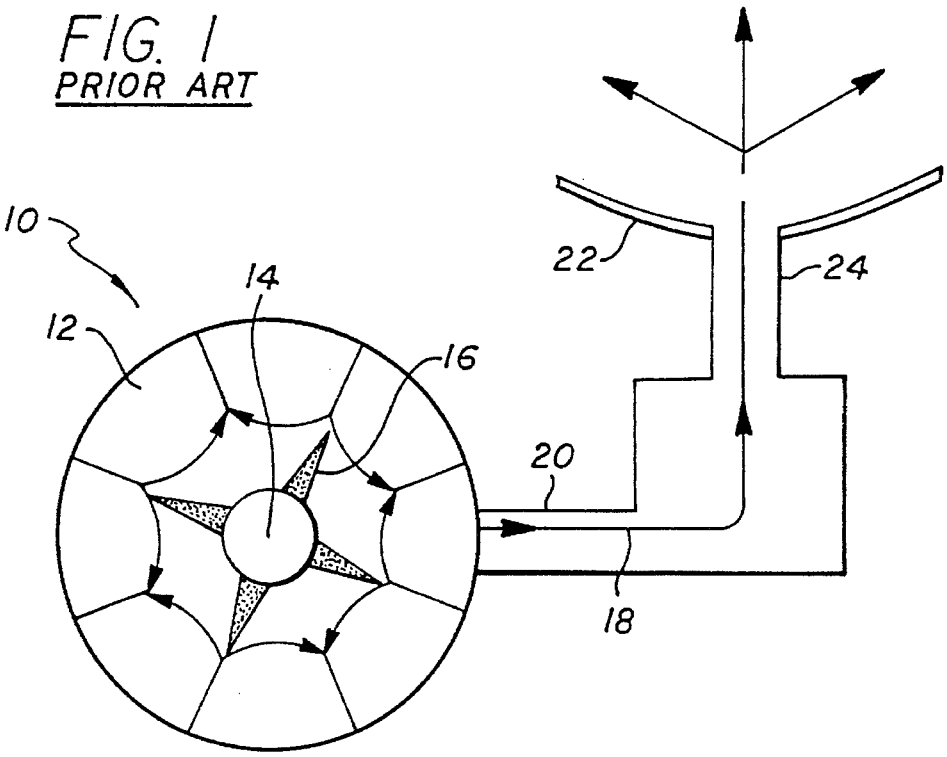
FIG. 1 PRIOR ART
FIG. 1 is a block diagram of a prior art magnetron and output waveguide.
Figure 2:
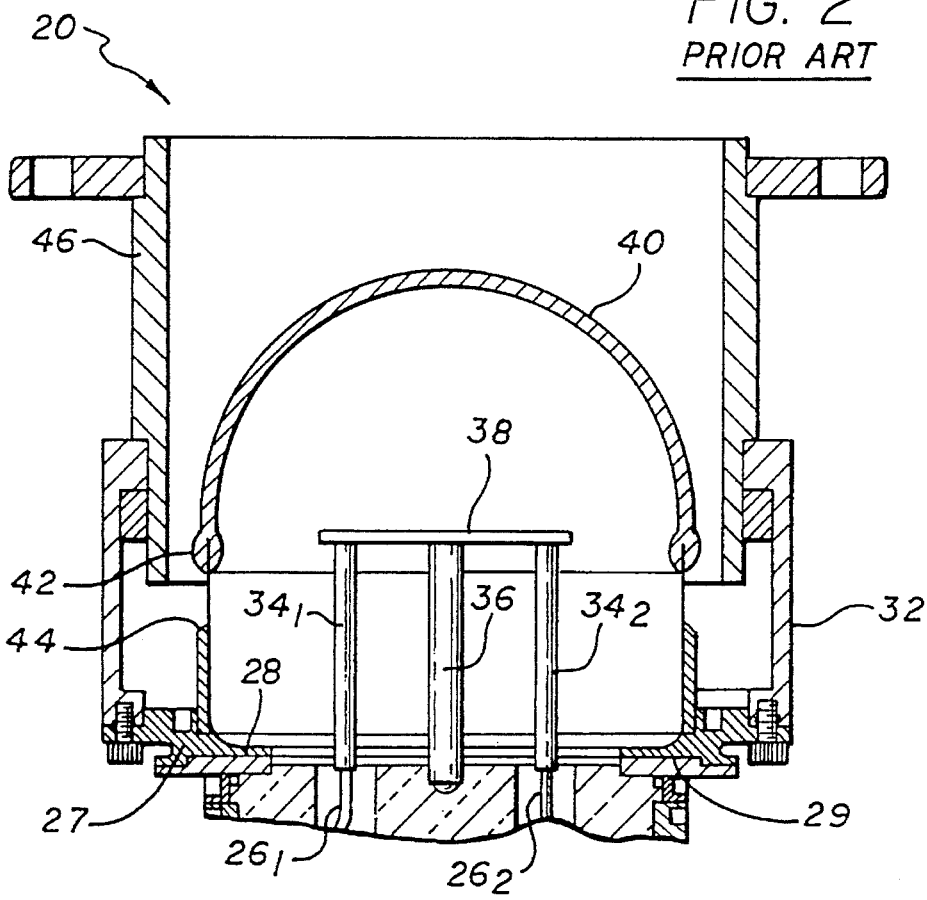
FIG. 2 PRIOR ART
FIG. 2 is a sectional side view of a prior art magnetron output transition apparatus utilizing a conventional glass dome.

Referring first to FIGS. 1 and 2, a prior art magnetron transition apparatus is illustrated in conjunction with a magnetron 10 (see FIG. 1). As known in the art and as shown in FIG. 1, the magnetron 10 comprises a cylindrical shaped cathode 14 coaxially disposed within an anode structure 12 comprising a resonant cavity tuned to provide a frequency of oscillation for the magnetron. Upon application of an electric potential between the cathode 14 and the anode 12, an electric field is produced which causes a space-charge cloud of electrons to emit from the cathode surface. A magnetic field provided along the axis of the cathode 14, perpendicular to the electric field, causes the emitted electrons to spiral into cycloidal paths in orbit around the cathode 14. When RF fields are present on the anode structure, the rotating space-charge cloud is concentrated into a spoke-like pattern. Electron current flows through the spokes 16 from the cathode 14 to the anode 12, producing a high power RF electromagnetic output signal at the desired frequency of oscillation.

The high power RF electromagnetic output signal is removed from the magnetron 10 through an output transition apparatus 20. The transition apparatus 20 couples the RF signal 18 into an output waveguide 24, which in turn directs the RF signal to a load, such as an antenna 22. The antenna 22 radiates the RF signal in a desired direction.

The prior art transition apparatus 20 of FIG. 1 is shown in greater detail in FIG. 2. The transition apparatus 20 has an end member 27 having a mating surface 29 which physically engages with a corresponding surface 28 of the magnetron. The mating surfaces 28 and 29 have a generally circular shape. A sleeve 32 provides an external housing for the transition apparatus 20, and extends axially from an external portion of the end member 27. A waveguide section 46 extends radially from an end of the sleeve 32 and provides a portion of the output waveguide 24 of FIG. 1. As known in the art, the waveguide section 46 can have either a circular or rectangular cross-section.

An internal support ring 44 concentric within the sleeve 32 extends axially from the end member 27. A glass dome 40 combines with the support ring 44 to produce a vacuum seal for the magnetron 10. The glass dome 40 has a bead 42 which is fused to an end of the support ring 44. The dome 40 is formed of a glass material capable of withstanding a pressure differential between a vacuum environment within the magnetron and a non-vacuum environment within the waveguide 46, while permitting transmission of microwave energy therethrough.

Coaxial electrical conductors $\mathbf{26_1}$ and $\mathbf{26_2}$ are electrically connected to the anode structure 12 of FIG. 1, and electrically conduct the RF signal from the magnetron into the space formed in the transition apparatus 20 below the dome 40. The conductors $\mathbf{26_1}$ and $\mathbf{26_2}$ have a greater diameter in the transition apparatus 20, shown at $\mathbf{34_1}$ and $\mathbf{34_2}$, respectively, which are electrically connected to a conductive cross-member 38. The cross-member 38 is electrically connected to ground through a ground conductor 36 centrally disposed along the cross-member between conductors $\mathbf{34_1}$ and $\mathbf{34_2}$. The ground conductor 36, cross-member 38 and conductors $\mathbf{34_1}$ and $\mathbf{34_2}$ may be formed of an electrically conducting material, such as copper.

The combination of the conductors $\mathbf{34_1}$ and $\mathbf{34_2}$ and the cross-member 38 provide a conductive loop which inductively couples electromagnetic energy from the magnetron 10 into the transition apparatus 20. As the RF signal is conducted through the conductors $\mathbf{26_1}$, $\mathbf{26_2}$, and cross-member 38, an RF electromagnetic signal is induced into the dome space. The RF signal transmits through the RF transparent glass dome 40 into the waveguide 46. Although the glass dome 40 effectively provides for transmission of the RF signal and provides a vacuum secure barrier, the glass dome cannot withstand high temperature processing of the magnetron 10, as substantially described above. Thus, a replacement for the glass dome 40 has been sought.

The present invention solves this deficiency of the prior art by providing a transition apparatus capable of forming an effective seal between the vacuum environment within the magnetron and the non-vacuum environment within the output waveguide. The transition apparatus is further capable of withstanding high temperature processing of the magnetron, and is relatively inexpensive to fabricate. Referring now to FIG. 3, a magnetron output transition apparatus 30 of the present invention is illustrated. The output transition apparatus 30 is intended to replace the prior art transition apparatus 20 discussed above, and has an end member 33 similar to the end member 27 of the prior art transition apparatus 20 of FIG. 2. An outer sleeve 56 extends axially from the end member 33 and provides an external housing for the transition apparatus 30.

In place of the glass dome 40, an adapter 50 is utilized. As illustrated in FIGS. 3 and 4, the adapter 50 has a first portion 52 having a generally circular cross-section, and a second portion 54 having a generally rectangular cross-section. At a midpoint between the first portion 52 and the second portion 54, the cross-section of the adapter tapers gradually between the two distinct portions. The adapter 50 can be formed of an electrically conductive material common to waveguide usage, such as copper.

As shown in FIG. 3, the adapter 50 engages a "pillbox window" 60 that forms a vacuum barrier within the magnetron. An end 53 of the first portion 52 sealingly engages the end member 33. The first portion 52 provides a space which encloses the cross-member 38 and provides a waveguide for the induced RF signal from the cross-member. An end 55 (also shown in FIG. 4) of the second portion 54 secures to a rectangular window 62 formed in a first disk member 58 has a depending flange 59 that. The first disk member 58 engages an end of the outer sleeve 56 at an outer peripheral portion. The first disk 58 provides a first end for the pillbox window 60. The pillbox window 60 has an outer sleeve 67 which joins the first disk 58 with a second disk 72, forming an end portion of the waveguide 24 (FIG. 1). The second disk 72 has a rectangular window 74 substantially parallel to the first window 62.

The pillbox window 60 has a circular ceramic disk 68 disposed substantially parallel to the end 55 of the adapter 50, between the first disk 58 and the second disk 72. The ceramic disk 68 is formed of a material generally conductive of microwave RF energy, yet strong enough to withstand the pressure differential between the vacuum and the non-vacuum environment. Moreover, the ceramic disk 68 can withstand the high temperatures achieved during processing of the magnetron 10. The circumference of the disk 68 brazes to a thin walled portion 65 of a support ring 66, which engages an inner portion of the sleeve 67. The support ring 66 has an expansion gap 64 external to the thin walled portion 65, which provides for differential thermal expansion of the disk 68 and support ring 66.

As in the prior art device of FIG. 2, the RF signal is conducted through the conductors $\mathbf{26}_1$, $\mathbf{26}_2$, $\mathbf{34}_1$, $\mathbf{34}_2$ into the cross-member 38, which is electrically connected to ground through the ground conductor 36. In operation, RF energy induced into the adapter 50 from the cross-member 38 travels through the first window 62 into the pillbox window. The RF energy then travels through the ceramic disk 68 to the second window 74, and into the output waveguide 24. The ceramic disk 68 of the pillbox window 60 provides a vacuum seal for the magnetron. Selection of the shape of the second portion 54 of the adapter 50 can be made consistent with the shapes of the first and second windows 62 and 74, so as to be further consistent with the cross-section of the output waveguide 24.

Having thus described a preferred embodiment of a magnetron output transition apparatus, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A magnetron output transition apparatus to transmit a microwave RF signal between a magnetron and an output waveguide, the apparatus comprising:

means for inductively coupling said microwave RF signal from said magnetron into said transition apparatus;

an adapter comprising a first portion having a generally circular cross section coupled to a second portion having a generally rectangular cross section, said first portion connected to said magnetron and receiving said inductively coupling means, said adapter maintaining a substantially vacuum environment therein; and an RF transparent window connected between said second portion of said adapter and said output waveguide to provide an interface between said substantially vacuum environment and a non-vacuum environment within said output waveguide;

wherein said microwave RF signal transmits through said adapter and said window to said output waveguide.

2. The transition apparatus of claim 1, wherein said inductively coupling means comprises a conductive loop disposed within said first portion.

3. The transition apparatus of claim 1, wherein said adapter is comprised of copper.

4. The transition apparatus of claim 1, wherein said second portion has a shape consistent with a corresponding shape of said output waveguide.

5. In a microwave RF signal generating device including a magnetron and an output waveguide having an RF transparent window to provide an interface between a substantially vacuum environment within the magnetron and a non-vacuum environment within the output waveguide, the improvement comprising:

an adapter comprising a first portion having a generally circular cross section coupled to a second portion having a generally rectangular cross section, said first portion connected to said magnetron and receiving said microwave RF signal, said second portion connected to said output waveguide, said adapter maintaining a substantially vacuum environment therein;

wherein said microwave RF signal transmits through said adapter and into said window.

6. The improvement of claim 5, further comprising:

means operatively connected between said magnetron and said adapter for inductively coupling said microwave RF signal from said magnetron into said adapter.

7. The improvement of claim 6, wherein said inductively coupling means comprises a conductive loop disposed within said first portion.

8. The improvement of claim 5, wherein said adapter is comprised of copper.

9. The improvement of claim 5, wherein said second portion has a shape consistent with a corresponding shape of said output waveguide.

10. A magnetron output transition apparatus to transmit a microwave RF signal between a magnetron and an output waveguide, the apparatus comprising:

an adapter having a first portion of generally circular cross section coupled to a second portion of generally rectangular cross section, said first portion connected to said magnetron and receiving said RF signal, said second portion operatively connected to said output waveguide, said adapter maintaining a substantially vacuum environment therein; and means for providing an RF interface between said substantially vacuum environment and a non-vacuum environment within said output waveguide;

wherein said microwave RF signal transmits through said adapter to said output waveguide.

11. The transition apparatus of claim 10, further comprising means operatively connected between said magnetron and said adapter for inductively coupling said microwave RF signal from said magnetron into said transition apparatus.

12. The transition apparatus of claim 11, wherein said inductively coupling means comprises a conductive loop disposed substantially within said first portion.

13. The transition apparatus of claim 10, wherein said means for providing an interface comprises an RF transparent window connected between said second portion of said adapter and said output waveguide.

14. The transition apparatus of claim 13, wherein said second portion has a shape consistent with a corresponding shape of said output waveguide.

15. The transition apparatus of claim 10, wherein said adapter is comprised of copper.

* * * * *